US007592054B2

(12) United States Patent
Ishida et al.

(10) Patent No.: US 7,592,054 B2
(45) Date of Patent: Sep. 22, 2009

(54) INK JET RECORDING MEDIUM

(75) Inventors: Tadashi Ishida, Sodegaura (JP); Yoshihiko Tomita, Sodegaura (JP); Masaya Kusumoto, Sodegaura (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 0 days.

(21) Appl. No.: 10/522,416

(22) PCT Filed: Aug. 6, 2003

(86) PCT No.: PCT/JP03/10006

§ 371 (c)(1), (2), (4) Date: Jan. 26, 2005

(87) PCT Pub. No.: WO2004/014658

PCT Pub. Date: Feb. 19, 2004

(65) Prior Publication Data

US 2006/0110552 A1 May 25, 2006

(30) Foreign Application Priority Data

Aug. 8, 2002 (JP) ..... 2002-231701

(51) Int. Cl.
*B41M 5/40* (2006.01)

(52) U.S. Cl. ..... 428/32.34; 428/32.35; 428/32.36; 428/32.37

(58) Field of Classification Search ..... 428/32.34, 428/32.36, 32.37, 32.35
See application file for complete search history.

(56) References Cited

U.S. PATENT DOCUMENTS

| | | | | |
|---|---|---|---|---|
| 5,478,631 | A | 12/1995 | Kawano et al. | |
| 5,910,359 | A | 6/1999 | Kobayashi et al. | |
| 6,001,466 | A | 12/1999 | Noguchi et al. | |
| 6,361,768 | B1 * | 3/2002 | Galleguillos et al. | 424/70.12 |
| 2002/0182378 | A1 | 12/2002 | Ishida et al. | |

FOREIGN PATENT DOCUMENTS

| | | | |
|---|---|---|---|
| JP | 07-045526 | B2 | 11/1987 |
| JP | 06-227114 | A | 8/1994 |
| JP | 7-1835 | A | 1/1995 |
| JP | 08-216504 | A | 8/1996 |
| JP | 09-296067 | A | 11/1997 |
| JP | 09-296068 | A | 11/1997 |
| JP | 10-166718 | A | 6/1998 |
| JP | 11-348415 | A | 12/1999 |
| JP | 2000-118125 | A | 4/2000 |
| JP | 2001-058461 | A | 3/2001 |
| JP | 2002-86905 | A | 3/2002 |
| JP | 2003-251934 | A | 9/2003 |
| JP | 2003-291518 | A | 10/2003 |

* cited by examiner

*Primary Examiner*—Betelhem Shewareged
(74) *Attorney, Agent, or Firm*—Buchanan Ingersoll & Rooney PC

(57) ABSTRACT

An ink jet recording medium which is excellent in ink absorptivity, color density, gloss, water resistance, light fastness and yellowing resistance, in particular, ink absorptivity, color density, light fastness and yellowing resistance. The ink jet recording medium comprises at least one ink receptive layer containing polymeric organic particles provided on a support, wherein the polymeric organic particles have a glass transition temperature (Tg) of 40° C. or higher and are amphoteric polymeric organic particles having both of the functional groups of a cationic group and an anionic group on the surface thereof.

5 Claims, No Drawings

INK JET RECORDING MEDIUM

BACKGROUND OF THE INVENTION

1. Field of the Invention

The present invention relates to an ink jet recording medium applied to a printer or plotter wherein an ink jet recording system is utilized.

2. Description of the Related Art

In recent years, the ink jet recording system can provide image quality comparable to that of photographs by virtue of the progress of a printing technology. For improving the image quality, the amount of ink in printing increases and the printing is also realized at high speed, and therefore the performance which ensures that ink is absorbed instantly and a large amount of ink is absorbed, is highly desired. At present, the recording medium is mainly a void-type recording medium that inorganic particles such as fine particle silica and alumina are used to form a layer having voids thereon and allows ink to be absorbed through the void. For improving the image quality, finer inorganic particles have been used. However, the finer the inorganic particles, the more sharply will the surface area thereof increase, and the surface activity thereof increases, and thus there is a problem that light resistance and yellowing resistance are remarkably deteriorated. Thus, it has been suggested that the organic particles are substituted for the inorganic particles.

Japanese Unexamined Patent Application Publication Nos. 2001-58461 and 8-216504 disclose that in the case where the cationic additives obtained by copolymerizing specific acrylic ester-based monomers are used without combining the inorganic particles therewith, provided is a recording medium which is excellent in water resistance and light fastness.

However, in these cationic additives, the organic particles form closest packing, thereby not providing sufficient voids, and thus there was a problem that satisfactory ink absorptivity is not obtained.

In order to prevent the closest packing, there has been proposed a method for coagulating the organic particles by a heat-sensitive gelling agent described in Japanese Unexamined Patent Application Publication Nos. 9-296067 and 9-296068. However, this method had a problem that it is difficult to control the aggregation thereof, a layer a layer having uniform voids is not formed, and thus ink absorptivity is partly varied, the particle size of the aggregate increases, and the color density is reduced.

On the other hand, Japanese Unexamined Patent Application Publication No. 6-227114 discloses the applications of the amphoteric polymeric organic particles having an anionic group and a cationic group as an ink jet recording sheet. Only use of ACCOSTAR C122 (manufactured by MITSUI CYANAMID, LTD.) of which the minimum film-forming temperature is 9° C. in Examples is exemplified, and the amphoteric ion latex is used as an adhesive of a pigment. In this technique, adhesiveness to the support, and surface strength and water resistance of the record sheet are improved, and further ink absorptivity is enhanced as compared to an aqueous emulsion-type polymer latex used as a conventional adhesive. However, the amphoteric ion latex is an emulsion having a high film-forming ability, which is used as an adhesive, and thus if a pigment is not combined therewith, ink absorption is not attained at all, thus the combination of the pigment being required. In addition, as a preferred example of the pigment, the fine particle silica is disclosed, which is used to, make up for the deteriorated, ink absorptivity, but light fastness and yellowing resistance cannot be prevented.

In addition, Japanese Examined Patent Application Publication No. 7-45526 discloses a method for preparing a cationic latex by copolymerizing cationic monomers, ethylenically unsaturated carboxylic acid monomers, aliphatic conjugated diene-based monomers and the other monomers, using a cationic emulsifying agent. In the technology described in the above publication, in the case where a latex essentially comprises aliphatic conjugated diene-based monomers and the latex is applied to an ink jet recording medium, light fastness of the latex is deteriorated due to the remaining double bonds derived from the aliphatic conjugated diene-based monomers, and thus there occurs a problem in a long term storage of the printed matter.

It is an object of the present invention to provide, for solving the above problems, an ink jet recording medium that is excellent in ink absorptivity, and also in color density, water resistance, light fastness and yellowing resistance.

SUMMARY OF THE INVENTION

The inventors have conducted intensive studies with a view to solving the above problems, and as a result, it has been found that an ink jet recording medium comprising at least one ink receptive layer containing polymeric organic particles provided on a support exhibits excellent ink absorptivity, color density, water resistance, light fastness and yellowing resistance, by using amphoteric polymeric organic particles having a glass transition temperature (Tg) of 40° C. or higher and having a cationic group and an anionic group. The present invention has been completed on the basis of this finding.

Specifically, the present invention is characterized by the following [1] to [4]:

[1] An ink jet recording medium comprising at least one ink receptive layer containing polymeric organic particles provided on a support, wherein the polymeric organic particles have a glass transition temperature (Tg) of 40° C. or higher and are amphoteric polymeric organic particles having a cationic group and an anionic group;

[2] The ink jet recording medium as described in [1], wherein the polymeric organic particles are (co)polymers of the monomers having an unsaturated double bond, or the polymeric organic particles mainly composed of the (co) polymers;

[3] The ink jet recording medium as described in [1] or [2], wherein the polymeric organic particles are the polymeric organic particles obtained by (co)polymerization of the monomers not containing aliphatic conjugated diene-based monomers; and

[4] The ink jet recording medium as described in any one of [1] to [3], wherein the weight average particle diameter of the polymeric organic particles is from 1 to 1000 nm.

An ink jet recording medium according to the present invention is the ink jet recording medium comprising at least one ink receptive layer containing polymeric organic particles provided on a support, wherein the polymeric organic particles have a glass transition temperature (Tg) of 40° C. or higher and are amphoteric polymeric organic particles having a cationic group and an anionic group. A reason why the ink jet recording medium is excellent in ink absorptivity, color density and water resistance is not clear, but it is presumed as follows.

Since when applying the polymeric organic particles on a support, water is penetrated into the support and is dried to scatter, and thus the polymeric organic particles are present at a higher concentration, leading to aggregation of the particles, and consequently water does not exist. In this process, in the case of the use of the cationic particles and the anionic particles, it is difficult to have aggregation of the particles, and thus it reaches approximately closest packing and there exists no water.

On the contrary, since the amphoteric polymeric organic particles have amphoteric ions, aggregation thereof easily occurs, and aggregation between the particles easily occurs before reaching the closest packing, thereby increasing voids. In addition, it is conceived that since the amphoteric polymeric organic particles of the present invention has a glass transition temperature of 40° C. or higher, dissolution and fusion of the particles in the drying process are hard to occur, the formed voids are maintained as it is, thus ink absorptivity being excellent. Further, it is conceived that since the amphoteric polymeric organic particles have a cationic group, an anionic dye in ink electrostatically is fixed, thereby color density and water resistance being excellent.

DESCRIPTION OF THE PREFERRED EMBODIMENTS

Hereinbelow, the ink jet recording medium according to the present invention will be described in detail.

The ink jet recording medium according to the present invention is one comprising at least one ink receptive layer containing amphoteric polymeric organic particles provided on a support.

The ink receptive layer as mentioned herein means all the layer which can absorb ink, which is provided on a support, and in the case of an ink jet recording medium comprising a plurality of ink receptive layers provided on a support, the polymeric organic particles of the present invention are contained in at least one of the ink jet receptive layers.

The amphoteric polymeric organic particles having an anionic group and a cationic group of the present invention have a glass transition temperature (Tg) of 40° C. or higher, preferably 60° C. or higher. When the glass transition temperature (Tg) is less than 40° C., fusion between the particles leads to easy reduction of voids to thereby deteriorate the ink absorptivity.

In addition, the glass transition temperature (Tg) referred to in the present invention can be determined from DSC curve in accordance with on JIS K 7121.

In the present invention, as a method wherein an anionic group is introduced into the amphoteric polymeric organic particles having an anionic group and a cationic group, there can be mentioned a method wherein an initiator having an anionic group is used, a method wherein the monomers having an anionic group are used, and a method wherein a surfactant having an anionic group is used. In addition, as a method wherein a cationic group is introduced, there can be mentioned a method wherein an initiator having a cationic group is used, a method wherein the monomers having a cationic group are used, and a method wherein a surfactant having a cationic group is used. In the case where as the method wherein an anionic group is introduced, the monomers having the anionic group are used, and as the method wherein the cationic group is introduced, the initiator having the cationic group and the surfactant having the cationic group are used, the stability of the polymeric organic particles to be polymerized is improved, thus it being a preferred embodiment.

In addition, as a preferred embodiment of the amphoteric polymeric organic particles of the present invention, there may be mentioned a (co)polymer of the monomers having an unsaturated double bond, or the polymeric organic particles comprising the (co)polymer as a main component. The polymeric organic particles mainly composed of the (co)polymer as mentioned herein mean composite polymeric organic particles of a (co)polymer of the monomers having an unsaturated double bond and other components, for example, inorganic particles such as silica and polymers such as aqueous urethanes and olefins, or a compound referred to as an ultraviolet absorber and a fluorescent brightener, the (co)polymer of the monomers having an unsaturated double bond being contained in an amount of usually 50% by weight or more in terms of the solid content thereof.

Examples of the monomer having an unsaturated double bond include:

aromatic vinyl monomers such as styrene, 2-methylstyrene, t-butylstyrene, chlorostyrene, vinylanisole, and vinylnaphthalene;

acrylic esters such as isopropyl acrylate, n-butyl acrylate, isobutyl acrylate, t-butyl acrylate, n-hexyl acrylate, 2-ethylhexyl acrylate, octyl acrylate, decyl acrylate, dodecyl acrylate, octadecyl acrylate, methyl acrylate, ethyl acrylate, cyclohexyl acrylate, phenyl acrylate, benzyl acrylate, isoboronyl acrylate, and other alkyl acrylates having 3 to 20 carbon atoms;

methacrylic esters such as isopropyl methacrylate, n-butyl methacrylate, isobutyl methacrylate, t-butyl metharylate, n-hexyl methacrylate, 2-ethylhexyl methacrylate, octyl methacrylate, decyl methacrylate, dodecyl methacrylate, octadecyl methacrylate, methyl methacrylate, ethyl methacrylate, cyclohexyl methacrylate, phenyl methacrylate, benzyl methacrylate, isoboronyl methacrylate, and other methacrylates having 3 to 20 carbon atoms;

hydroxyl group-containing vinyl monomers such as 2-hydroxyethyl acrylate, hydroxypropyl acrylate, 4-hydroxybutyl acrylate, 2-hydroxyethyl methacrylate, hydroxypropyl methacrylate, and 4-hydroxybutyl methacrylate;

amides such as acrylamide, methacrylamide, N-methylolmethacrylamide, N-methylolacrylamide, diacetone acrylamide, and maleic acid amide;

halogenated vinylidene monomers such as vinylidene chloride and vinylidene fluoride;

vinyl esters such as vinyl acetate and vinyl propionate; and other monomers such as chloroethylene, vinyl ether, vinyl ketone, vinylamide, chloroprene, ethylene, propylene, vinylpyrrolidone, 2-methoxyethyl acrylate, 2-ethoxyethyl acrylate, glycidyl acrylate, glycidyl methacrylate, allyl glycidyl ether, acrylonitrile, methacrylonitrile, 1,2,2,6,6-pentamethyl-4-piperidyl (meth)acrylate, 2,2,6,6-tetramethyl-4-piperidyl (meth)acrylate, and 2-(2'-hydroxy-5'-methacryloyloxyethylphenyl)-2H-benzotriazole.

In addition, examples of the monomer having an anionic group include:

unsaturated carboxylic acid monomers such as acrylic acid, methacrylic acid, itaconic acid, maleic acid, fumaric acid, acrylic anhydride, methacrylic anhydride, maleic anhydride, itaconic anhydride, and fumaric anhydride;

unsaturated sulfonic acid monomers such as styrenesulfonic acid, sodium styrenesulfonate, and 2-acrylamide-2-methylpropanesulfonic acid; and unsaturated phosphoric acid monomers such as mono(2-methacryloyloxyethyl) phosphate and mono(2-acryloyloxyethyl) phosphate.

In addition, examples of the monomer having a cationic group include:

monomers having a tertiary amino group, e.g., N,N-dialkylaminoalkyl acrylates and N,N-dialkylaminoalkyl methacrylates, such as N,N-dimethylaminoethyl acrylate, N,N-dimethylaminoethyl methacrylate, N,N-dimethylaminopropyl acrylate, N,N-dimethylaminopropyl methacrylate, N,N-diethylaminoethyl acrylate, N,N-diethylaminoethyl methacrylate, N,N-diethylaminopropyl acrylate and N,N-diethylaminopropyl methacrylate; N,N-dialkylacrylamides and N,N-dialkylmethacrylamides, such as N,N-dimethylacrylamide, N,N-dimethylmethacrylamide, N,N-diethylacrylamide and N,N-diethylmethacrylamide; N,N-dialkylaminoalkylacrylamides and N,N-dialkylaminbalkylmethacrylamides, such as N,N-dimethylaminopropylacrylamide, N,N-dimethylaminopropyl methacrylamide, N,N-dimethylaminoethylacrylamide and N,N-dimethylaminoethylmethacrylamide; and other N-isopropylacrylamide and N,N-dimethylamino(2-hydroxy)propyl ethacrylate; and monomers having a quaternary ammonium group, wherein the monomers having a tertiary amino group are quaternized with a halogenated methyl group, a halogenated ethyl group, and a halogenated benzyl group, which are halogenated with a halogen atom such as chlorine, bromine and iodine.

In addition, for the purpose of improving the heat resistance of the polymeric organic particles or other purposes, there can also be used together with a crosslinking agent such as ethylene glycol dimethacrylate, diethylene glycol dimethacrylate, triethylene glycol dimethacrylate, polyethylene glycol dimethacrylate, polypropylene glycol dimethacrylate, neopentyl glycol dimethacrylate, 1,3-butylene glycol dimethacrylate, 1,6-hexanediol dimethacrylate, neopentyl glycol dimethacrylate, polyethylene glycol diacrylate, 1,6-hexanediol diacrylate, neopentyl glycol diacrylate, tripropylene glycol diacrylate, polypropylene glycol diacrylate, trimethylolpropane trimethacrylate, trimethylolpropane triacrylate, tetramethylolmethane triacrylate, tetramethylolmethane tetraacrylate, allyl methacrylate, dicyclopentenyl acrylate, dicyclopentenyloxyethyl acrylate, isopropenyl-α, α-dimethylbenzyl isocyanate, allyl mercaptan, divinylbenzene and methylene bisacrylamide.

In addition, when a (co)polymer is obtained, if necessary, as a molecular weight modifier, mercaptans such as t-dodecyl mercaptan and n-dodecyl mercaptan, an allyl compound such as allylsulfonic acid, methallylsulfonic acid and the sodium salts thereof, or the like can be used.

An average particle diameter of the amphoteric polymeric organic particles having an anionic group and a cationic group, according to the present invention, is preferably 1 nm to 1000 nm, more preferably 1 nm to 500 nm, even more preferably 1 to 300 nm. When the average particle diameter is less than 1 nm, insufficient voids may be provided and thus the ink absorptivity may be lowered, while when it exceeds 1000 nm, the color density may be lowered.

The weight average molecular weight of the amphoteric polymeric organic particles having an anionic group and a cationic group of the present invention is 10000 or more, more preferably 30000 or more, even more preferably 60000 or more. With the weight average molecular weight of less than 10000, the deformation of organic particles may be likely to occur to thereby reduce voids, and thus the ink absorptivity may be deteriorated.

The amphoteric polymeric organic particles having an anionic group and a cationic group in the present invention can be produced according to a conventionally well-known emulsion polymerization process or a mechanical emulsification process. For example, in the emulsion polymerization process, there can be employed a method wherein various monomers are simultaneously charged and polymerized in the presence of a dispersant and an initiator and a method wherein monomers are continuously fed and polymerized. In the emulsion polymerization process, the polymerization temperature is usually 30 to 90° C., and thus substantially a water dispersion of the organic particles can be obtained.

The initiator for use in the production of the polymeric organic particles of the present invention, can be any initiators for use in a common emulsion polymerization, and examples thereof include:

as an initiator having a cationic group, 2,2'-azobis(2-amidinopropane) dihydrochloride, 2,2'-azobis[2-(N-phenylamidino)propane]dihydrochloride, 2,2'-azobis{2-[N-(4-chlorophenyl)amidino]propane}dihydrochloride, 2,2'-azobis{2-[N-(4-hydroxyphenyl)amidino]propane}dihydrochloride, 2,2'-azobis[2-(N-benzylamidino)propane]dihydrochloride, 2,2'-azobis[2-(N-allylamidino)propane]dihydrochloride, 2,2'-azobis{2-[N-(2-hydroxyethyl)amidino]propane}dihydrochloride, 2,2'-azobis(2-methylbutaneamidoxime) dihydrochloride, or the like;

as an anionic initiator, persulfates such as ammonium persulfate, potassium persulfate and sodium persulfate, or the like;

as a nonionic initiator, organic peroxides such as cumene hydroperoxide, t-butyl hydroperoxide, benzoyl peroxide, t-butylperoxy-2-ethylhexanoate, t-butylperoxybenzoate and lauroyl peroxide and azo compounds such as azobisisobutyronitrile, 2,2'-azobis{2-methyl-N-[1,1-bis(hydroxymethyl)-2-hydroxyethyl]propionamide}, 2,2'-azobis{2-methyl-N-[1,1-bis(hydroxymethyl)ethyl]propionamide}, 2,2'-azobis[2-methyl-N-[2-hydroxyethyl]propionamide] and 2,2'-azobis(isobutylamide) dihydrate.

The dispersant for use in the production of the polymeric organic particles of the present invention, can be the dispersant used in a common emulsion polymerization, and particularly a cationic surfactant, an amphoteric surfactant, a nonionic surfactant or the like are preferably used.

The cationic surfactant includes, for example, alkyltrimethylammonium chlorides such as lauryltrimetylammonium chloride, stearyltrimethylammonium chloride and cetyltrimethylammonium chloride; dialkyldimethylammonium chlorides such as distearyldimethylammonium chloride; alkylamine salts such as coconut amine acetate and stearylamine acetate; alkylbenzyl dimethylammonium chlorides such as laurylbenzyldimethylammonium chlorides; alkylamine guanidine polyoxylethanol; and alkylpicolinium chloride. One, or two or more kinds can be selected from these.

The amphoteric surfactant includes, for example, alkyldimethylaminoacetic acid betaines such as lauryldimethylaminoacetic acid betaine and stearyldimethylaminoacetic acid betaine; alkyl dimethylamine oxides such as lauryl dimethylamine oxide and stearyl dimethylamine oxide; alkylcarboxymethylhydroxyethylimidazolinium betaine, alkylamidopropyl betaine, and alkylsulfobetaine. One, or two or more kinds can be selected from these.

Specific examples of the nonionic surfactant include polyoxyethylene lauryl ether, polyoxyethylene octyiphenyl ether, polyoxyethylene oleylphenyl ether, polyoxyethylene nonyiphenyl ether, oxyethylene-oxypropylene block copolymer, tert-octylphenoxyethylpolyethoxyethanol, and nonylphenoxyethylpolyethoxyethanol. One, or two or more kinds can be selected from these.

Cationic or anionic particles can also be used in combination with the amphoteric polymeric organic particles having an anionic group and a cationic group of the present invention. When coating and drying only such cationic or anionic particles on a support, closest packing thereof leads to the deterioration of the ink absorptivity, but the existence of the amphoteric particles suppresses closest packing, giving excellent ink absorptivity. As the cationic or anionic particles, inorganic particles or organic particles can be used, but the cationic organic particles are preferred because they may provide excellent color density, light fastness and water resistance.

The ink jet recording medium according to the present invention may comprise a polymer having a binder function for the purpose of improving surface strength and gloss. The polymer having binder function includes, for example, a water dispersion of a water soluble polymer or a water insoluble polymer, or the like. Hereinbelow, it will be described in detail.

The water soluble polymer includes, for example, as the cationic water soluble polymer, cationized polyvinyl alcohol, cationized starch, cationized polyacrylamide, cationized polymethacrylamide, polyamidopolyurea, polyethyleneimine, a copolymer of allylamine or its salt, an epichlorohydrin/dialkyl amine adduct polymer, a polymer of diallylalkylamine or its salt, a polymer of a diallyldialkylammonium salt, a copolymer of diallylamine or its salt and sulfur dioxide, a diallyldialkylammonium salt/sulfur dioxide copolymer, a copolymer of diallyldialkylammonium salt and diallylamine or its salt or a derivative thereof, a copolymer of a quaternary salt of dialkylaminoethyl(meth)acrylate, a diallyldialkylammonium salt/acrylamide copolymer, an amine/carboxylic acid copolymer or the like.

Further, it also includes, as a nonionic water soluble polymer, polyvinyl alcohol or its derivative; starch derivatives such as oxidized starch, etherified starch or phosphate esterified starch; polyvinyl pyrrolidone or a polyvinyl pyrrolidone derivative such as polyvinyl pyrrolidone obtained by copolymerization with vinyl acetate; cellulose derivatives such as carboxymethyl cellulose and hydroxymethyl cellulose; polyacrylamide or its derivative; polymethacrylamide or its derivative; gelatin; casein or the like.

Further, the water dispersion of the water insoluble polymer includes, for example, a water dispersion of a cationic and/or nonionic acrylic polymer (a polymer or copolymer of acrylic ester and/or methacrylic ester), an MBR polymer (a methyl methacrylate/butadiene copolymer), an SBR polymer (a styrene/butadiene copolymer), an urethane polymer, an epoxy polymer or an EVA polymer (an ethylene/vinyl acetate copolymer).

A water dispersion of polyvinyl alcohol, cationized polyvinyl alcohol or an acrylic polymer (a polymer or copolymer of acrylic ester and/or methacrylic ester) is preferably used, particularly from the viewpoint of the characteristics of excelling in yellowing resistance. In addition, use of a cationic water soluble polymer or a cationic water insoluble polymer is preferable because it gives improved color density or water resistance.

In addition, the ink jet recording medium according to the present invention may include, in addition to these, a wetting agent, an antistatic agent, an antioxidant, a dry paper strength additive, a wet paper strength additive, a waterproofing agent, an antiseptic agent, an ultraviolet absorber, a photostabilizer, a fluorescent brightener, a coloring pigment, a coloring dye, a penetrant, a blowing agent, a mold release agent, a foam inhibitor, a defoaming agent, a fluidity improver, and a thickening agent or the like.

In addition, the recording medium having excellent ink absorptivity may be obtained by comprising a layer containing a pigment such as silica with excellent ink absorptivity which is superimposed in sequence on a support, and an adhesive such as polyvinyl alcohol as a binder thereof and a layer containing the polymeric organic particles according to the present invention.

In the present invention, as the support, use can be made of supports conventionally used in the ink jet recording sheets, for example, a paper support such as plain paper, art paper, coated paper, cast coated paper, resin coated paper, resin impregnated paper, noncoated paper and coated paper; a paper support having its both sides coated with polyolefin, a plastic support, a nonwoven fabric, a cloth, a woven fabric, a metal film, a metal plate and a composite support consisting of a laminate of these.

As the plastic support, there can preferably be used, for example, a sheet or film of plastic such as polyethylene, polypropylene, polystyrene, polyethylene terephthalate, polyethylene naphthalate, triacetylcellulose, polyvinyl chloride, polyvinylidene chloride, polyimide, polycarbonate, cellophane, and polynylon. Among these plastic supports, transparent, translucent or opaque ones can appropriately be selected according to intended use.

It is also preferred to use a white plastic film as the support. As the white plastic support, use can be made of a support constituted of a plastic compounded with a small amount of a white pigment such as barium sulfate, titanium oxide and zinc oxide, a foamed plastic support provided with opacity by forming a multiplicity of minute voids, or a support furnished with a layer containing a white pigment (titanium oxide or barium sulfate).

In the present invention, although the configuration of the support is not limited, not only customarily employed films, sheets and plates but also cylindrical forms such as that of a drink can, disc forms as that of CD or CD-R and other complex forms can be used as the support.

In the present invention, when the polymeric organic particles are coated on a support, use can be made of, for example, conventionally known application techniques by means of an air knife coater, a roll coater, a bar coater, a blade coater, a slide hopper coater, a gravure coater, a flexogravure coater, a curtain coater, an extrusion coater, a floating knife coater, a comma coater, a die coater or the like.

Further, when it is intended to impart gloss to the coating surface, for example, a common calendering treatment can be applied. For example, there can be used the conventionally known method wherein with the use of a calendar machine such as a supercalender and a gloss calender, the recording medium is passed through gap between rolls having pressure and heat applied thereto so as to smooth the surface of the coating layer. In addition, a cast coating technique such as a direct method, a solidification method, a re-wetting method and a precasting method, which is generally used in the production of a cast coated paper for printing, can also be preferably used.

EXAMPLES

The present invention will be further described below with reference to the following Examples, which however in no way limit the scope of the present invention. Herein, the parts and % refer to parts by weight and % by weight, respectively, unless otherwise specified.

Example 1

<Production of Amphoteric Polymeric Organic Particles having an Anionic Group and a Cationic Group>

600.0 parts of deionized water and 1.5 parts of lauryltrimethylammomium chloride were charged into a reaction vessel, and the pH of the mixture was adjusted to 2 with an aqueous hydrochloric acid solution. The reaction mixture was heated to 65° C. in a nitrogen stream, and 3.0 parts of 2,2'- azobis(2-amidinopropane) dihydrochloride was added to the mixture. Separately, 120.0 parts of styrene, 135.0 parts of t-butyl methacrylate, 30.0 parts of 2-hydroxyethyl methacrylate and 15.0 parts of methacrylic acid were emulsified into 120.0 parts of deionized water in the presence of 6.0 parts of lauryltrimethylammonium chloride to thereby obtain an emulsified mixture. This emulsified mixture was dropped into the reaction vessel over a period of 4 hours. Thereafter, the mixture was maintained at the same temperature for 4 hours and then the nonvolatile content thereof was adjusted to 30% with deionized water. As a result, an aqueous composition consisting of the amphoteric polymeric organic particles having an anionic group and a cationic group dispersed in water was obtained. The aqueous composition had the nonvolatile content of 30% and the pH of 2.7. The polymeric organic particles had the average particle diameter of 70 nm as determined by observation through an electron microscope and the glass transition temperature (Tg) of 105° C.

<Production of Recording Sheet>

A wood free paper having a basis weight of 105 g/m$^2$ was coated with the aqueous composition of the amphoteric polymeric organic particles having an anionic group and a cationic group dispersed in water so that the coating amount was 20 g/m$^2$ in absolute dry condition, and the resultant coating layer was subjected to the cast coating process, specifically pressing the coating layer surface against a specular roll of 70° C. surface temperature at a linear pressure of 50 kg/cm and effecting drying. As a result, a recording sheet of Example 1 was obtained.

Example 2

<Production of Amphoteric Polymeric Organic Particles having an Anionic Group and a Cationic Group>

600.0 parts of deionized water and 1.5 parts of lauryltrimethylammomium chloride were charged into a reaction vessel, and the pH of the mixture was adjusted to 2 with an aqueous hydrochloric acid solution. The reaction mixture was heated to 65° C. in a nitrogen stream, and 3.0 parts of 2,2'-azobis(2-amidinopropane) dihydrochloride was added to the mixture. Separately, 120.0 parts of styrene, 144.0 parts of t-butyl methacrylate, 30.0 parts of 2-hydroxyethyl methacrylate and 6.0 parts of methacrylic acid were emulsified into 120.0 parts of deionized water in the presence of 6.0 parts of lauryltrimethylammonium chloride to thereby obtain an emulsified mixture. This emulsified mixture was dropped into the reaction vessel over a period of 4 hours. Thereafter, the mixture was maintained at the same temperature for 4 hours and then the nonvolatile content thereof was adjusted to 30% with deionized water. As a result, an aqueous composition consisting of the amphoteric polymeric organic particles having an anionic group and a cationic group dispersed in water was obtained. The aqueous composition had the nonvolatile content of 30% and the pH of 2.7. The polymeric organic particles had the average particle diameter of 65 nm as determined by observation through an electron microscope and the glass transition temperature (Tg) of 103° C.

<Production of Recording Sheet>

Using the above obtained aqueous composition, a recording sheet was produced in the same manner as in Example 1.

Comparative Example 1

<Production of Cationic Organic Particles>

600.0 parts of deionized water and 1.5 parts of lauryltrimethylammomium chloride were charged into a reaction vessel and heated to 65° C. in a nitrogen stream. 3.0 parts of 2,2'-azobis(2-amidinopropane) dihydrochloride was added to the mixture. Separately, 150.0 parts of styrene, 135.0 parts of methyl methacrylate and 15.0 parts of 2-hydroxyethyl methacrylate were emulsified into 120.0 parts of deionized water in the presence of 1.2 parts of lauryltrimethylammonium chloride to thereby obtain an emulsified mixture. This emulsified mixture was dropped into the reaction vessel over a period of 4 hours. Thereafter, the mixture was maintained at the same temperature for 4 hours and then the nonvolatile content thereof was adjusted to 30% with deionized water. As a result, an aqueous composition consisting of the cationic polymeric organic particles dispersed in water was obtained. The aqueous composition had the nonvolatile content of 30% and the pH of 5.4. The polymeric organic particles had the average particle diameter of 70 nm as determined by observation through an electron microscope and the glass transition temperature (Tg) of 103° C.

<Production of Recording Sheet>

Using the above obtained aqueous composition, a recording sheet was produced in the same manner as in Example 1.

Comparative Example 2

<Production of Anionic Organic Particles>

600.0 parts of deionized water and 0.6 part of sodium dodecylbenzenesulfonate were charged into a reaction vessel, and heated to 70° C. in a nitrogen stream. 1.8 parts of potassium persulfate was added to the mixture. Separately, 75.0 parts of styrene, 180.0 parts of methyl methacrylate, 30.0 parts of 2-hydroxyethyl methacrylate and 15.0 parts of methacrylic acid were emulsified into 120.0 parts of deionized water in the presence of 0.6 part of sodium dodecylbenzensulfonate to thereby obtain an emulsified mixture. This emulsified mixture was dropped into the reaction vessel over a period of 4 hours. Thereafter, the mixture was maintained at the same temperature for 4 hours and then the nonvolatile content thereof was adjusted to 30% with deionized water. As a result, an aqueous composition consisting of the anionic polymeric organic particles dispersed in water was obtained. The aqueous composition had the nonvolatile content of 30% and the pH of 2.4. The polymeric organic particles had the average particle diameter of 105 nm as determined by observation through an electron microscope and the glass transition temperature (Tg) of 105° C.

<Production of Recording Sheet>

Using the above obtained aqueous composition, a recording sheet was produced in the same manner as in Example 1.

Comparative Example 3

<Production of Amphoteric Polymeric Organic Particles with a Low Tg>

600.0 parts of deionized water and 1.5 parts of lauryltrimethylammomium chloride were charged into a reaction vessel, and the pH of the mixture was adjusted to 2 with an aqueous hydrochloric acid solution. The reaction mixture was heated to 65° C. in a nitrogen stream, and 3.0 parts of 2,2'-azobis(2-amidinopropane) dihydrochloride was added to the mixture. Separately, 120.0 parts of styrene, 144.0 parts of n-butyl acrylate, 30.0 parts of 2-hydroxyethyl methacrylate and 6.0 parts of methacrylic acid were emulsified into 120.0 parts of deionized water in the presence of 6.0 parts of lauryltrimethylammonium chloride to thereby obtain an emulsified mixture. This emulsified mixture was dropped into the reaction vessel over a period of 4 hours. Thereafter, the mixture was maintained at the same temperature for 4 hours and then the nonvolatile content thereof was adjusted to 30% with deionized water. As a result, an aqueous composition consisting of the amphoteric polymeric organic particles having an anionic group and a cationic group dispersed in water was obtained. The aqueous composition had the nonvolatile content of 30% and the pH of 2.9. The polymeric organic particles had the average particle diameter of 68 nm as determined by observation through an electron microscope and the glass transition temperature (Tg) of 16° C.

<Production of Recording Sheet>

Using the above obtained aqueous composition, a recording sheet was produced in the same manner as in Example 1.

Comparative Example 4

<Production of Amphoteric Polymeric Organic Particles by Copolymerization of Diene Monomers>

792.0 parts of deionized water, 0.6 part of lauryltrimethylammonium chloride, 15 parts of 2,2'-azobis(2-amidinopropane) dihydrochloride, 260.0 parts of styrene, 35.0 parts of methyl methacrylate, 15.0 parts of methacrylic acid and 15.0 parts of butadiene were charged into an autoclave, and heated to 50° C. in a nitrogen stream. When the polymerization conversion reached 80% and the reaction mixture was heated to 60° C. When the polymerization conversion reached 99%, the reaction mixture was cooled to remove the unreacted materials in the emulsion by stripping and thus to obtain an aqueous composition consisting of the amphoteric polymeric organic particles dispersed in water. The nonvolatile content of the aqueous composition was adjusted to 30% with deionized water. The aqueous composition had the nonvolatile content of 30% and the pH of 5.3. The polymeric organic particles had the average particle diameter of 80 nm as determined by observation through an electron microscope and the glass transition temperature (Tg) of 93° C.

<Production of Recording Sheet>

Using the above obtained aqueous composition, a recording sheet was produced in the same manner as in Example 1.

Comparative Example 5

<Use of Commercially Available Amphoteric Polymeric Organic Particles>

<Production of Recording Sheet>

Using of ACCOSTAR C122 [manufactured by Mitsui Cytec Co., Ltd.] which was a commercially available amphoteric latex (a solid content 40%, a particle diameter 0.2 μm, and a minimum film-forming temperature 9° C.), a recording sheet was produced in the same manner as in Example 1.

[Method of Evaluation]

The quality evaluation results of the recording sheets are listed in Tables 1 and 2. The evaluation was conducted in the following manner.

<Method of Measuring Gloss>

In the gloss measurement, the level of gloss at 60° C. of the surface of the recording sheet was measured by means of deformation glossmeter model GM-3D (manufactured by Murakami Color Research Laboratory) in accordance with JIS Z8741.

<Method of Measuring Color Density>

Solid printing with black ink and cyan ink was performed effected on each recording sheet by means of a commercially available ink jet printer (PM2000C manufactured by Seiko Epson Corporation). The optical reflection density of a solid part was measured by means of Macbeth densitometer (RD-918).

<Method of Measuring Ink Absorptivity>

For evaluating ink absorptivity, setting property and image irregularity were evaluated.

(Setting Property)

Solid printing of each of yellow ink, magenta ink, cyan ink and black ink was effected in the longitudinal direction of the recording sheet by means of a commercially available ink jet printer (PM800C manufactured by Seiko Epson Corporation). Immediately after delivery from the printer, PPC paper was pressed onto the upper surface of the recording sheet, and the degree of transfer of ink from the recording sheet to the PPC paper was evaluated by visual inspection. The evaluation criteria were as follows:

○: No ink transfer was observed, thereby attesting to excellent ink absorptivity;

Δ: Slight ink transfer was observed, but the ink absorptivity was a practicable level; and x: Ink transfer was extensive, so that the ink absorptivity was below a practical level.

(Image irregularity)

Female photograph of highly fine color digital standard image data (ISO/JIS-SCID) was printed on the recording sheet by means of a commercially available ink jet printer (PM800C manufactured by Seiko Epson Corporation), and image irregularity was evaluated by visual inspection. When the ink absorptivity is poor, image irregularity occurs due to insufficient ink absorption. The evaluation criteria were as follows:

○: No image irregularity was observed, thereby attesting to excellent ink absorptivity;

Δ: Slight image irregularity was observed, but the ink absorptivity was a practicable level; and x: Image irregularity was extensive, and hence the ink absorptivity was below a practical level.

<Method of Measuring Water Resistance>

Character printing with black ink was effected by means of a commercially available ink jet printer (PM800C manufactured by Seiko Epson Corporation). One drop of city water was placed on the printed portion, and allowed to stand still round the clock. Thereafter, the print condition was evaluated by visual inspection. The evaluation criteria were as follows:

○: There was almost no bleeding;

Δ: Slight bleeding was observed, but a practical level; and x: Bleeding was observed, and hence below a practical level.

<Method of Measuring Light Fastness>

Solid printing with magenta ink was effected on each recording sheet by means of a commercially available ink jet printer (PM800C manufactured by Seiko Epson Corporation). The printed recording sheet was exposed to light for 100 hours by means of a xenon fadeometer, and the residual ratio of the optical reflection density after light exposure, relative to the optical reflection density before light exposure was measured and referred to as light fastness. The optical reflection density was measured by means of Macbeth densitometer (RD-918).

<Method of Measuring Yellowing Resistance>

The unprinted recording sheet was exposed to light for 7 hours by means of a carbon arc fadeometer, and the difference between color before light exposure and color after light exposure was measured. The color difference (ΔE) in terms of L*a*b* (expression method according to CIE) was calculated by the formula $\Delta E=\{(\Delta L^*)^2+(\Delta a^*)^2+(\Delta b^*)^2\}^{1/2}$ from the results of measuring of color before the light exposure and color after the light exposure. The larger the color difference, the more serious the color deterioration.

TABLE 1

| | Properties of polymeric organic particles | | Ink absorptivity | | Color density | |
|---|---|---|---|---|---|---|
| | Ionic property of particles | Tg of particles | Setting property | Image irregularity | Black | Cyan |
| Ex. 1 | Amphoteric | 105° C. | ○ | ○ | 2.05 | 1.98 |
| Ex. 2 | Amphoteric | 103° C. | ○ | ○ | 2.07 | 1.97 |
| Com. Ex. 1 | Cationic | 103° C. | Δ | x | 2.05 | 1.98 |
| Com. Ex. 2 | Anionic | 105° C. | Δ | x | 1.24 | 1.33 |
| Com. Ex. 3 | Amphoteric | 16° C. | x | x | Unmeasurable | Unmeasurable |
| Com. Ex. 4 | Amphoteric | 93° C. | Δ | Δ | 1.88 | 1.82 |
| Com. Ex. 5 | Amphoteric | (MFT 9° C.) | x | x | Unmeasurable | Unmeasurable |

MFT: Minimum film-forming temperature

TABLE 2

| | Gloss | Water resistance | Light fastness | Yellowing resistance |
|---|---|---|---|---|
| Ex. 1 | 63 | ○ | 84% | 1.1 |
| Ex. 2 | 59 | ○ | 85% | 1.1 |
| Com. Ex. 1 | 53 | ○ | 85% | 1.1 |
| Com. Ex. 2 | 54 | x | 64% | 1.2 |
| Com. Ex. 3 | 50 | Unmeasurable | Unmeasurable | Unmeasurable |
| Com. Ex. 4 | 52 | ○ | 48% | 1.8 |
| Com. Ex. 5 | 47 | Unmeasurable | Unmeasurable | Unmeasurable |

According to the present invention, there can be obtained an ink jet recording medium which is excellent in ink absorptivity, color density, gloss, water resistance, light fastness and yellowing resistance, in particular, ink absorptivity, color density, light fastness and yellowing resistance.

What is claimed is:

1. An ink jet recording medium comprising at least one ink receptive layer containing polymeric organic particles provided on a support, wherein the ink receptive layer is formed by coating the support with an aqueous composition comprising the polymeric organic particles dispersed in water, wherein the polymeric organic particles have a glass transition temperature (Tg) of 40° C. or higher and an average particle diameter of 1 to 500 nm, and are amphoteric polymeric organic particles having a cationic group and an anionic group, wherein the polymeric organic particles are obtained by (co)polymerization of monomers not containing aliphatic conjugated diene-based monomers.

2. The ink jet recording medium according to claim 1, wherein the polymeric organic particles are (co)polymers of monomers having an unsaturated double bond, or the polymeric organic particles are comprised of the (co)polymers.

3. The ink jet recording medium according to claim 1, wherein the average particle diameter of the polymeric organic particles is from 1 to 300 nm.

4. The ink jet recording medium according to claim 2, wherein the average particle diameter of the polymeric organic particles is from 1 to 300 nm.

5. The ink jet recording medium according to claim 1, wherein the average particle diameter of the polymeric organic particles is from 65 to 500 nm.

* * * * *